US011629834B2

(12) United States Patent
Mandl et al.

(10) Patent No.: US 11,629,834 B2
(45) Date of Patent: Apr. 18, 2023

(54) PROJECTION MODULE FOR A MOTOR VEHICLE HEADLAMP

(71) Applicant: ZKW Group GmbH, Wieselburg (AT)

(72) Inventors: Bernhard Mandl, Ober-Grafendorf (AT); Tobias Karas, Leiben (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 17/781,472

(22) PCT Filed: Nov. 16, 2020

(86) PCT No.: PCT/EP2020/082182
§ 371 (c)(1),
(2) Date: Jun. 1, 2022

(87) PCT Pub. No.: WO2021/121817
PCT Pub. Date: Jun. 24, 2021

(65) Prior Publication Data

US 2023/0052888 A1 Feb. 16, 2023

(30) Foreign Application Priority Data

Dec. 20, 2019 (EP) ..... 19218697

(51) Int. Cl.
*F21S 41/43* (2018.01)
*F21S 41/147* (2018.01)
*F21S 41/25* (2018.01)

(52) U.S. Cl.
CPC ..... *F21S 41/43* (2018.01); *F21S 41/147* (2018.01); *F21S 41/25* (2018.01)

(58) Field of Classification Search
None
See application file for complete search history.

(56) References Cited

U.S. PATENT DOCUMENTS 10,071,674 B2 * 9/2018 Rosenhahn ..... F21S 41/43
2010/0226142 A1 9/2010 Brendle et al.
(Continued)

OTHER PUBLICATIONS

International Search Report for PCT/EP2020/082182, dated Dec. 23, 2020 (12 pages).
(Continued)

*Primary Examiner* — Elmito Breval
(74) *Attorney, Agent, or Firm* — Eversheds Sutherland (US) LLP

(57) ABSTRACT

A projection module (10) for a motor vehicle headlamp, comprising a first light source (110) and a second light source (120), a beam stop (200), which is horizontally arranged, and which comprises an optically relevant stop edge (210) for creating an asymmetric light-dark boundary, wherein the first light source (110) is arranged on a top side of the beam stop (200) and, in combination with the stop edge (210), contributes to the creation of a low beam distribution, and wherein the second light source (120) is arranged on a bottom side of the beam stop (200) and contributes to the creation of a high beam distribution, and a projection lens (300), wherein the projection module (10) comprises an auxiliary stop (400), which is vertically arranged below the beam stop (200), and which has a vertically extending first optically relevant stop edge (410), which is configured to partially shade light from the second light source (120), so that a partial high beam distribution can be created, and wherein the auxiliary stop (400) has a fastening section (430), wherein, in the vertical extension in the direction of the beam stop (200), the first stop edge (410) has an end (411), which end (411) has a distance from the beam stop (200), and wherein the auxiliary stop (400) has a second optically relevant stop edge (420), which, starting at the end (411) of the first stop edge (410), extends all the way to the fastening section (430), wherein, in a projection onto
(Continued)

the beam stop (200), the second stop edge (420) defines a gap, which gap, in combination with the second light source (120), is configured to create a segment (500) in the partial high beam distribution.

20 Claims, 3 Drawing Sheets

(56) References Cited

U.S. PATENT DOCUMENTS

| | | | |
|---|---|---|---|
| 2014/0321143 | A1 | 10/2014 | Hossfeld et al. |
| 2016/0039330 | A1 | 2/2016 | Rosenhahn et al. |
| 2017/0241609 | A1 | 8/2017 | Luo et al. |

OTHER PUBLICATIONS

Search Report for European Patent Application No. 19218697.1 dated Jul. 27, 2020 (6 pages).

* cited by examiner

PROJECTION MODULE FOR A MOTOR VEHICLE HEADLAMP

The invention relates to a projection module for a motor vehicle headlamp, said projection module comprising the following:

a first light source and a second light source, a beam stop, which is configured to be horizontally arranged in the case of a use of the projection module as intended in an installed motor vehicle headlamp, and which comprises an optically relevant stop edge for creating an asymmetric light-dark boundary, wherein the first light source is arranged on a top side of the beam stop and, in combination with the optically relevant stop edge of the beam stop, contributes to the creation of a low beam distribution, and wherein the second light source is arranged on a bottom side of the beam stop and contributes to the creation of a high beam distribution, at least one projection lens comprising an optical axis and a focus area for projecting a light distribution in a main direction of beam in front of the projection module, wherein the stop edge of the beam stop for creating a sharp light-dark boundary is essentially arranged in the focus area of the projection lens, and wherein the optical axis coincides with the main direction of beam.

This can be, for example, a projection module for realizing a high beam or a high beam distribution, respectively. Said projection module is to image a divided high beam cloud for the left and right headlamp, which can be pivoted apart in the case of fade-out. To attain this, vertical tabs or an auxiliary stop, respectively, which is arranged vertically, are arranged on the beam stop, which is arranged horizontally in the module.

A light function is thereby understood to be the creation of a legally prescribed light distribution through the projection module or a motor vehicle headlamp, respectively. The low beam distribution and the high beam distribution are examples for such light distributions.

By means of controlling, an automatic high beam switching takes place, for example, with a partial high beam function, which is provided so that a part of the high beam distribution remains activated in spite of traffic ahead and/or oncoming traffic. The projection module or the motor vehicle headlamp, respectively, or a motor vehicle headlamp system, respectively, thereby creates a non-illuminated partial region in the high beam distribution at that location where other road users are located, so that the other road users are not blinded, these parts are, for example, pivoted apart—if a left and a right headlamp are present, which in each case create a part of a common high beam distribution, wherein a non-illuminated region, in which the oncoming traffic or traffic ahead, respectively, is positioned, is created between these parts. If the oncoming road user or the road user ahead, respectively, is now located very close to the motor vehicle, for example, the non-illuminated region can no longer be enlarged by means of a pivoting-apart of the parts of the high beam distribution, because the pivot angle is too large. One of the headlamps, for example the left headlamp, has to be turned off in such a case, so that the non-illuminated region can be enlarged.

Such a high beam distribution, which is partially shaded, will be referred to below as partial high beam distribution, which is generally created by a single motor vehicle headlamp or the projection module in this motor vehicle headlamp, respectively. Projection modules of this type are realized or implemented, respectively, in various embodiments in motor vehicle headlamps.

They ensure that one half of the high beam cloud is in each case cut off, for example, at 3.5°, on the H-H line. However, no distinction is made in the case of the legal requirements because an individual compliance of the headlamps is required, i.e., some points and lines of the legal evaluation in the high beam have to also be met at that location which no light can reach by isolation of the auxiliary stops, which are set up.

This does not represent a problem in the case of the evaluation for the ECE-AFS standard, because the left and the right headlamp are added together here, and the light intensity is then measured, divided by two. To also obtain an approval of this ADB alternative with partial high beam in China (CCC standard) and in the USA (FMVSS), the headlamps, however, are no longer evaluated jointly, as in the case of the evaluation with regard to the ECE standard, but an individual compliance of the respective headlamps is mandated.

It is an object of the invention to provide an improved projection light module.

This object is solved in that the projection module comprises an auxiliary stop, which is configured to be vertically arranged below the beam stop in the case of a use of the projection module as intended in a motor vehicle headlamp, and which has a vertically extending first optically relevant stop edge, which is arranged spaced apart from the optical axis, wherein the first optically relevant stop edge is configured to partially shade light from the second light source, so that a partial high beam distribution can be created, and wherein the auxiliary stop has a bearing section, on which the auxiliary stop bears against the beam stop, wherein, in the vertical extension in the direction of the beam stop, the first optically relevant stop edge has an end, which has a distance from the beam stop, and wherein the auxiliary stop has a second optically relevant stop edge, which, starting at the end of the first optically relevant stop edge, extends all the way to the bearing section, wherein, in the vertical direction to the beam stop, a distance of the second optically relevant stop edge defines a gap, which gap, in combination with the second light source, is configured to create a segment in the partial high beam distribution.

The terms relating to a location or an orientation, such as, for example, "horizontally", "vertically", "in the horizontal direction", "in the vertical direction", "top", "bottom", "front", "rear", "below", "on top of", etc. generally furthermore refer to a proper installation position of the present projection module in a motor vehicle headlamp.

The auxiliary stop is provided with a gap or slit, respectively. In combination with a raising or lowering, respectively, this gap provides for a worldwide approval of the partial high beam or of the partial high beam distribution, respectively.

For left-hand traffic, the arrangement can be arranged so as to be mirrored about the sagittal plane.

It can be provided that the first optically relevant stop edge of the auxiliary stop is configured to horizontally shade the high beam distribution, which can be created, at −5° to −1°, preferably at −3.5°, on an aiming screen.

It can be provided that the gap is configured to create a segment in the partial high beam distribution, which segment extends horizontally from −3.5° up to maximally −12°, preferably up to maximally −6°, preferably up to maximally −5°, and which extends vertically up to 2°, preferably up to 1°, preferably up to 0.2°, on an aiming screen.

This is a solid angle, so that the distance of the aiming screen is generally not relevant.

It can be provided that the aiming screen is arranged at a distance of 25 m from the projection module.

It can be provided that the bream stop and the auxiliary stop form an inherently rigid composite stop.

"Rigid" is thereby understood such that the beam stop and the auxiliary stop are connected to one another in such a way that relative movements are prevented, if possible, or should not be possible, respectively.

It can be provided that the focus area of the projection lens is curved, wherein the course of the optically relevant stop edge of the beam stop essentially follows the curved focus area.

It can be provided that the auxiliary stop is arranged orthogonally onto the optical axis of the projection lens.

It can be provided that the first optically relevant stop edge of the auxiliary stop is spaced apart in the direction of the optical axis of the projection lens, wherein the distance is 1 mm, preferably 8/10 mm.

It is important to note that "distance" also includes such a distance, in the case of which the first optically relevant stop edge of the auxiliary stop is spaced apart in the direction of the optical axis to or opposite to the arrangement direction of the projection lens.

By means of such a distance, the light-dark boundary of the partial high beam distribution or of the segment, which can be created, in the partial light distribution, respectively, is to be improved to the effect that resulting color fringes are to be reduced. In this context, what shall apply is that the larger the above-mentioned distance, the more bluish the color fringe of the light-dark boundary appears.

It can be provided that the auxiliary stop has at least one hole for a signlight light distribution. Only the creation of individual regions or points, respectively, is thus provided for the signlight light distribution.

It can be provided that the bearing section is formed as fastening section, on which the auxiliary stop is fastened to the beam stop.

The invention will be described in more detail below on the basis of exemplary drawings, in which FIG. 1 shows a schematic side view of an exemplary projection module comprising a horizontal beam stop;

Figure 1:
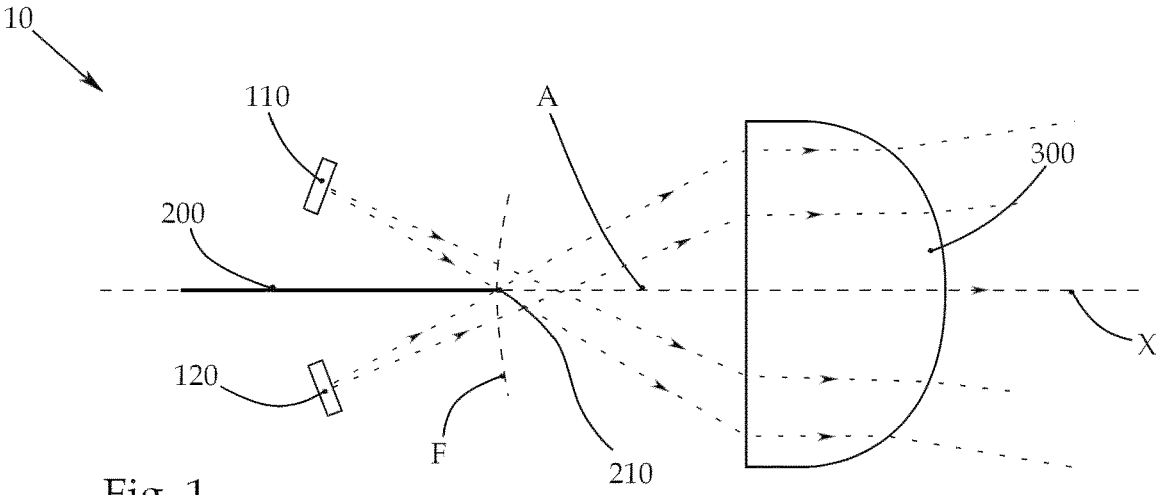

FIG. 1 shows a projection module 10 for a motor vehicle headlamp, which projection module 10 comprises a first light source 110 and a second light source 120 as well as a beam stop 200, which is configured to be horizontally arranged in the case of a use of the projection module 10 as intended in an installed motor vehicle headlamp, and which has an optically relevant stop edge 210 for creating an asymmetric light-dark boundary.

The first light source 110 is thereby arranged on a top side of the beam stop 200 and, in combination with the optically relevant stop edge 210 of the beam stop 200, contributes to the creation of a low beam distribution, wherein the second light source 120 is arranged on a bottom side of the beam stop 200 and contributes to the creation of a high beam distribution.

The projection module 10 further comprises a projection lens 300 comprising an optical axis A and a focus area F for projecting a light distribution in a main direction of beam X in front of the projection module 10, wherein the stop edge 210 of the beam stop 200 for creating a sharp light-dark boundary is essentially arranged in the focus area F of the projection lens 300, and wherein the optical axis A coincides with the main direction of beam X.

Figure 2:
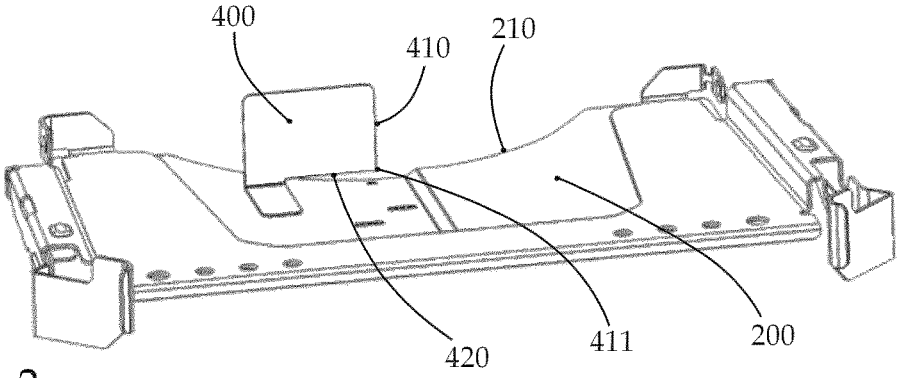
FIG. 2 shows a perspective view of an exemplary beam stop, comprising an auxiliary stop standing vertically on the beam stop.
Figure 3:
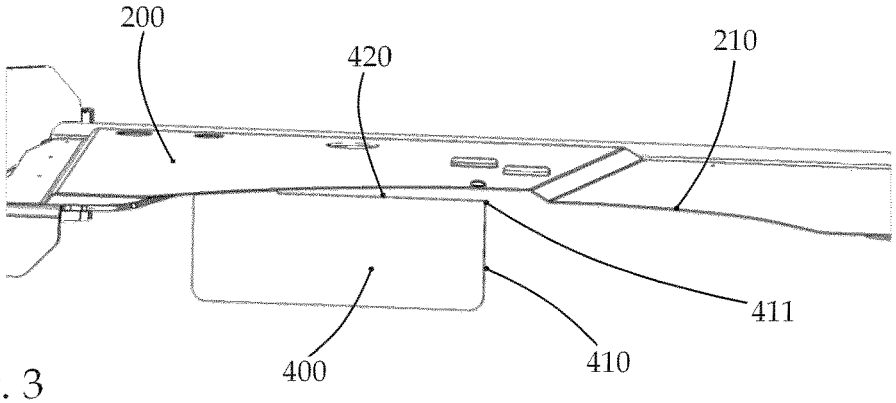
FIG. 3 shows a further perspective view of the beam stop from FIG. 2.

The projection module 10 further comprises an auxiliary stop 200 (not illustrated in FIG. 1), which can be seen in more detail in FIG. 2 and which is configured to be vertically arranged below the beam stop 200 in the case of a use of the projection module 10 as intended in a motor vehicle headlamp, and which has a vertically extending first optically relevant stop edge 410, which is arranged spaced apart from the optical axis A. FIG. 2 shows the beam stop 200 comprising the auxiliary stop 400 in a view obliquely from behind and from below.

The first optically relevant stop edge 410 is configured to partially shade light from the second light source 120, so that a partial high beam distribution can be created, wherein the auxiliary stop 400 has a fastening section 430, on which the auxiliary stop 400 is fastened to the beam stop 200, wherein the beam stop 200 and the auxiliary stop 400 form an inherently rigid composite stop.

In the vertical extension in the direction of the beam stop 200, the first optically relevant stop edge 410 has an end 411, which end 411 has a distance from the beam stop 200.

Figure 4:
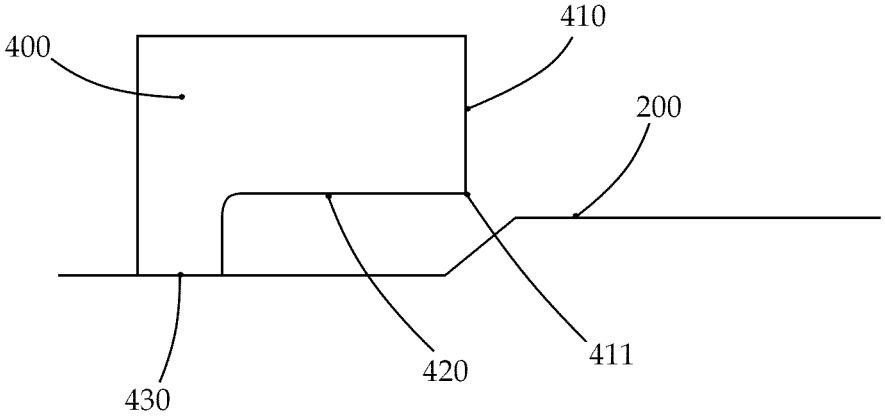
FIG. 4 shows a schematic front view of the beam stop from FIG. 2.

The auxiliary stop 400 further has a second optically relevant stop edge 420, which, starting at the end 411 of the first optically relevant stop edge 410, extends all the way to the fastening section 430, as illustrated schematically in FIG. 4.

In a projection or an orthogonal projection, respectively, onto the beam stop 200, the second optically relevant stop edge 420 thereby defines a gap, which gap, in combination with the second light source 120, is configured to create a segment in the partial high beam distribution.

In other words, the gap is defined by the distance of the second optically relevant stop edge 420 from the beam stop 200 in the vertical direction or in the direction of extension of the auxiliary stop 400, respectively.

Figure 5:
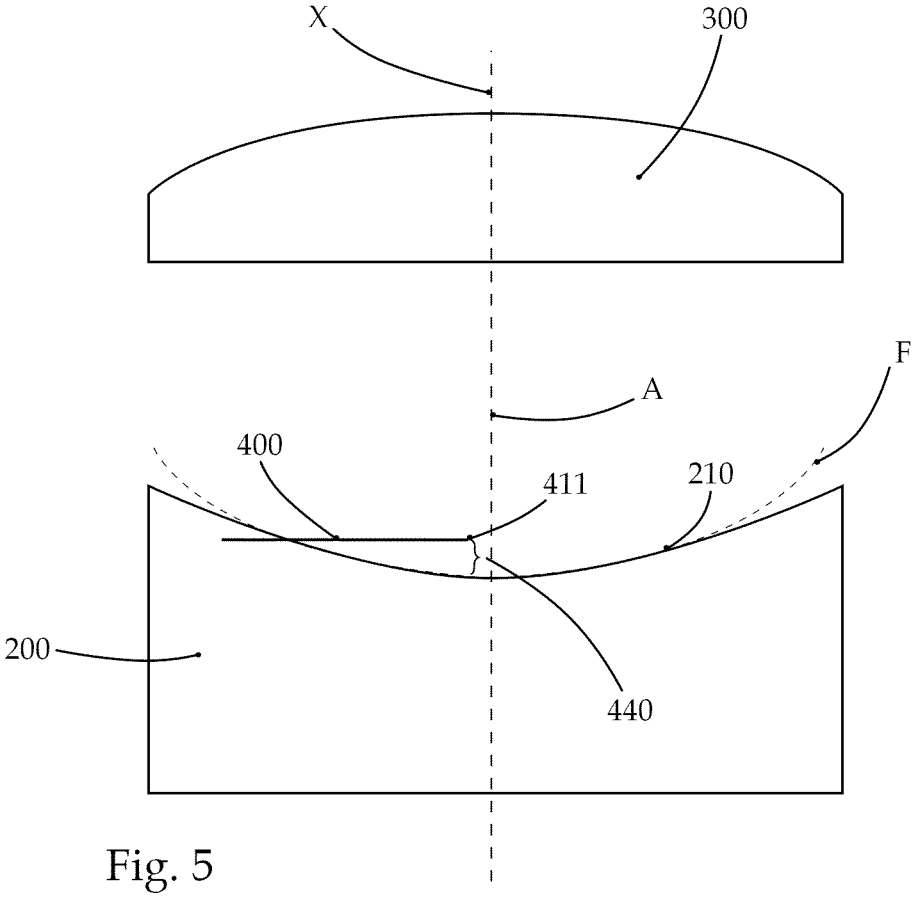
FIG. 5 shows a view from below of the schematic illustration of the exemplary projection module from FIG. 1.

FIG. 5 shows a schematic view of the projection module 10 from below, whereby it can be seen that the first optically relevant, vertical stop edge 410 and the end 411 of the stop edge 410 are spaced apart from the optical axis A of the projection lens, wherein the distance 440 formed in this way is 1 mm, preferably 8/10 mm.

It can further be seen that the auxiliary stop 400 is arranged orthogonally onto the optical axis A of the projection lens 300.

It can further be seen that the focus area F of the projection lens 300 is curved, wherein the course of the optically relevant stop edge 210 of the beam stop 200 essentially follows the curved focus area F.

Figure 6:
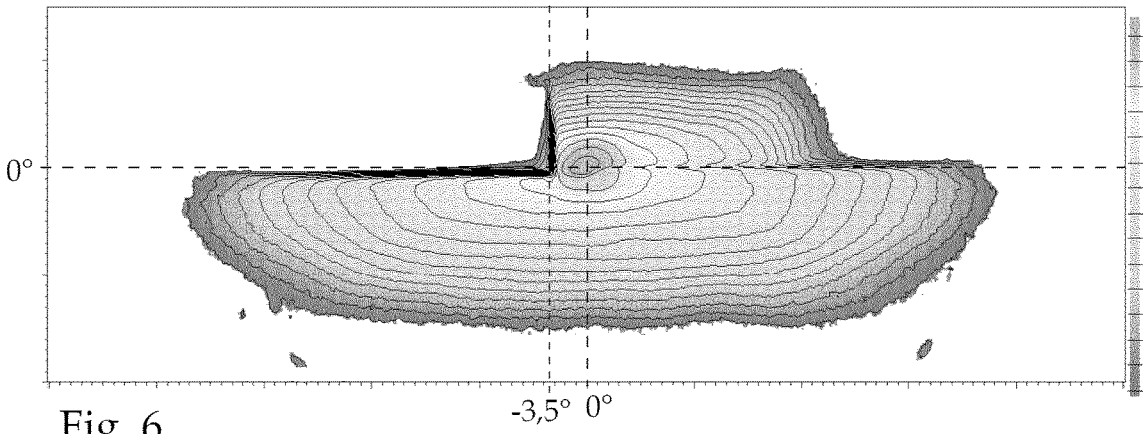
FIG. 6 shows a partial high beam distribution from the prior art.

FIG. 6 shows a partial high beam distribution from the prior art or from an example, respectively, in which the first optically relevant, vertical stop edge 410 of the auxiliary stop 400 in the vertical extension would reach all the way to the beam stop 200. It can be seen thereby that the first optically relevant stop edge of the auxiliary stop horizontally shades the high beam distribution at −3.5°.

Figure 7:
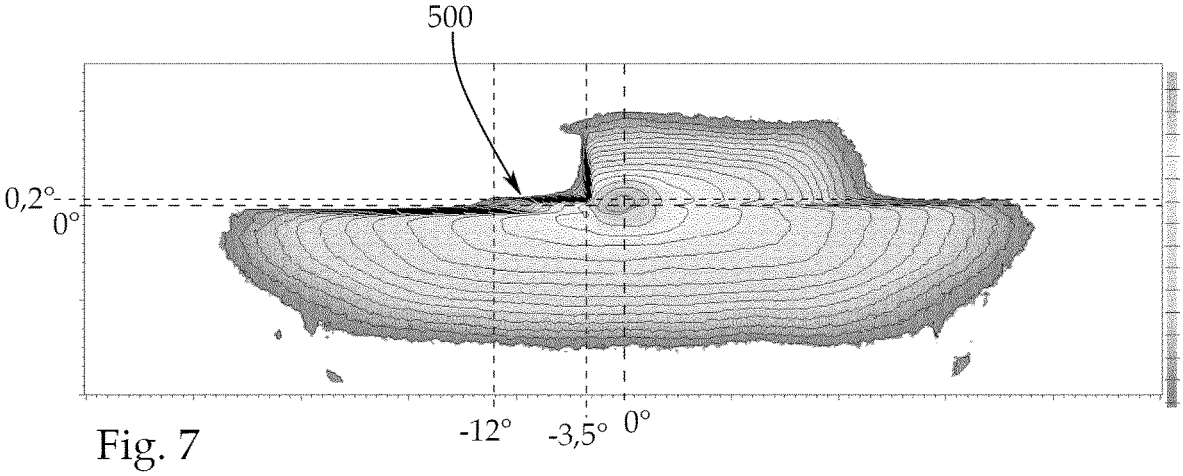
FIG. 7 shows a partial high beam distribution, which can be created by the projection module according to the invention.

FIG. 7 shows a partial high beam distribution, which can be created by the projection module 10 according to the invention, wherein the above-mentioned gap, which is defined by the auxiliary stop, is configured to create a segment 500 in the partial high beam distribution, which segment 500 extends horizontally from −2° up to maximally −12°, preferably up to maximally −6°, preferably up to maximally −5°, preferably exactly up to maximally −3.5°, and which extends vertically up to 2°, preferably up to 1°, preferably up to 0.2°, on the aiming screen.

The invention claimed is:

1. A projection module (10) for a motor vehicle headlamp, the projection module (10) comprising:

a first light source (110) and a second light source (120);

a beam stop (200), which is configured to be horizontally arranged in the case of a use of the projection module (10) as intended in an installed motor vehicle headlamp, and which comprises an optically relevant stop edge (210) for creating an asymmetric light-dark boundary, wherein the first light source (110) is arranged on a top side of the beam stop (200) and, in combination with the optically relevant stop edge (210) of the beam stop (200), contributes to the creation of a low beam distribution, and wherein the second light source (120) is arranged on a bottom side of the beam stop (200) and contributes to the creation of a high beam distribution; and at least one projection lens (300) comprising an optical axis (A) and a focus area (F) for projecting a light distribution in a main direction of beam (X) in front of the projection module (10), wherein the stop edge (210) of the beam stop (200) for creating a sharp light-dark boundary is essentially arranged in the focus area (F) of the projection lens (300), and wherein the optical axis (A) coincides with the main direction of beam (X), wherein the projection module (10) comprises an auxiliary stop (400), which is configured to be vertically arranged below the beam stop (200) in the case of a use of the projection module (10) as intended in a motor vehicle headlamp, and which has a vertically extending first optically relevant stop edge (410), which is arranged spaced apart from the optical axis (A), wherein the first optically relevant stop edge (410) is configured to partially shade light from the second light source (120), so that a partial high beam distribution can be created, and wherein the auxiliary stop (400) has a bearing section (430), on which the auxiliary stop (400) bears against the beam stop (200), wherein, in the vertical extension in the direction of the beam stop (200), the first optically relevant stop edge (410) has an end (411), which end (411) has a distance from the beam stop (200), and wherein the auxiliary stop (400) has a second optically relevant stop edge (420), which, starting at the end (411) of the first optically relevant stop edge (410), extends all the way to the bearing section (430), wherein, in the vertical direction to the beam stop (200), a distance of the second optically relevant stop edge (420) defines a gap, which gap, in combination with the second light source (120), is configured to create a segment (500) in the partial high beam distribution.

2. The projection module according to claim 1, wherein the first optically relevant stop edge (410) of the auxiliary stop (400) is configured to horizontally shade the high beam distribution, which can be created, at −5° to −1°, on an aiming screen.

3. The projection module according to claim 2, wherein the aiming screen is arranged at a distance of 25 m from the projection module.

4. The projection module according to claim 2, wherein the first optically relevant stop edge (410) of the auxiliary stop (400) is configured to horizontally shade the high beam distribution at −3.5° on an aiming screen.

5. The projection module according to claim 2, wherein the gap is configured to create a segment (500) in the partial high beam distribution, which segment (500) extends horizontally from −2° up to maximally −12°, and which extends vertically up to 2°, on an aiming screen.

6. The projection module according to claim 1, wherein the gap is configured to create a segment (500) in the partial high beam distribution, which segment (500) extends horizontally from −2° up to maximally −12°, and which extends vertically up to 2° on an aiming screen.

7. The projection module according to claim 1, wherein the beam stop (200) and the auxiliary stop (400) form an inherently rigid composite stop.

8. The projection module according to claim 1, wherein the focus area (F) of the projection lens (300) is curved, wherein the course of the optically relevant stop edge (210) of the beam stop (200) essentially follows the curved focus area (F).

9. The projection module according to claim 1, wherein the auxiliary stop (400) is arranged orthogonally onto the optical axis (A) of the projection lens (300).

10. The projection module according to claim 1, wherein the first optically relevant stop edge (410) of the auxiliary stop (400) is spaced apart in the direction of the optical axis (A) of the projection lens (300), wherein the distance (440) is 1 mm.

11. The projection module according to claim 1, wherein the auxiliary stop (400) has at least one hole for a signlight light distribution.

12. The projection module according to claim 1, wherein the bearing section (430) is formed as fastening section, on which the auxiliary stop (400) is fastened to the beam stop (200).

13. The projection module according to claim 1, wherein the gap is configured to create a segment (500) in the partial high beam distribution, which segment (500) extends horizontally from −2° up to maximally −6°, and which extends vertically up to 2°, on an aiming screen.

14. The projection module according to claim 1, wherein the gap is configured to create a segment (500) in the partial high beam distribution, which segment (500) extends horizontally from −2° up to maximally −5°, and which extends vertically up to 2°, on an aiming screen.

15. The projection module according to claim 1, wherein the gap is configured to create a segment (500) in the partial high beam distribution, which segment (500) extends horizontally from −2° up to maximally −12°, and which extends vertically up to 1°, on an aiming screen.

16. The projection module according to claim 1, wherein the gap is configured to create a segment (500) in the partial high beam distribution, which segment (500) extends horizontally from −2° up to maximally −12°, and which extends vertically up to 0.2°, on an aiming screen.

17. The projection module according to claim 1, wherein the gap is configured to create a segment (500) in the partial high beam distribution, which segment (500) extends horizontally from −2° up to maximally −6°, and which extends vertically up to 1°, on an aiming screen.

18. The projection module according to claim 1, wherein the gap is configured to create a segment (500) in the partial high beam distribution, which segment (500) extends horizontally from −2° up to maximally −6°, and which extends vertically up to 0.2°, on an aiming screen.

19. The projection module according to claim 1, wherein the gap is configured to create a segment (500) in the partial high beam distribution, which segment (500) extends horizontally from −2° up to maximally −5°, and which extends vertically up to 0.2°, on an aiming screen.

20. The projection module according to claim 1, wherein the first optically relevant stop edge (410) of the auxiliary stop (400) is spaced apart in the direction of the optical axis (A) of the projection lens (300), wherein the distance (440) is 8/10 mm.

* * * * *